US006658964B2

(12) United States Patent
Bang

(10) Patent No.: US 6,658,964 B2
(45) Date of Patent: Dec. 9, 2003

(54) ACCELERATION PEDAL DEVICE OF AUTOMOBILE

(75) Inventor: Chang-Seob Bang, Ulsan (KR)

(73) Assignee: Hyundai Motor Company, Seoul (KR)

( * ) Notice: Subject to any disclaimer, the term of this patent is extended or adjusted under 35 U.S.C. 154(b) by 98 days.

(21) Appl. No.: 09/973,909

(22) Filed: Oct. 11, 2001

(65) Prior Publication Data

US 2002/0078783 A1 Jun. 27, 2002

(30) Foreign Application Priority Data

Dec. 22, 2000 (KR) ..... 2000-80355

(51) Int. Cl.[7] ..... G05G 1/14
(52) U.S. Cl. ..... 74/512
(58) Field of Search ..... 74/512–514, 560

(56) References Cited

U.S. PATENT DOCUMENTS 4,273,211 A * 6/1981 Sarmiento ..... 74/513
5,214,979 A * 6/1993 Crack ..... 74/502.2
5,632,184 A * 5/1997 Callicutt et al. ..... 74/512
6,182,525 B1 * 2/2001 Bowers et al. ..... 74/512
6,186,025 B1 * 2/2001 Engelgau et al. ..... 74/512
6,361,074 B1 * 3/2002 Nonaka et al. ..... 280/777

FOREIGN PATENT DOCUMENTS

EP 1096355 A2 * 5/2001 ..... G05G/1/14
JP 2000198368 A * 7/2000 ..... B60K/26/02

* cited by examiner

*Primary Examiner*—Chong H. Kim
(74) *Attorney, Agent, or Firm*—Birch, Stewart, Kolasch & Birch, LLP

(57) ABSTRACT

An acceleration pedal device of an automobile, the device comprising: an acceleration pedal arm movably mounted by manipulating power of a driver; an acceleration cable connected to the acceleration pedal arm for being strained or relaxed according to movement of the acceleration pedal arm; and forcibly moving unit of acceleration pedal arm for utilizing a shock generated in the course of collision to reduce a protruding height of the acceleration pedal arm toward a driver when the shock is transmitted to the acceleration cable, such that the acceleration pedal arm of acceleration pedal device is accommodated into a housing by rotary movement of a pinion and retrograding movement of a rack bar when a shock generated in the course of collision of the automobile is transmitted to the acceleration pedal device via a dash panel, thereby reducing a protruding height of the acceleration pedal arm toward a driver whereby the driver is saved from injury on shin part resulting from collision with the acceleration pedal arm and pedal pad.

3 Claims, 4 Drawing Sheets

ACCELERATION PEDAL DEVICE OF AUTOMOBILE

BACKGROUND OF THE INVENTION

1. Field of the Invention

The present invention relates to an acceleration pedal of an automobile, and more particularly to an acceleration pedal of an automobile constructed to prompt an acceleration pedal to be moved to a direction distancing from a driver when the automobile collides, thereby preventing injuries in the shin of the driver.

2. Description of the Prior Art

In an acceleration pedal device in the known art, as illustrated in FIG. 1, a mounting bracket 11 is fixed to a dash panel 10 comprising a body of the automobile via fastening means such as bolts and the like, an acceleration pedal arm 12 is rotatively mounted at a predetermined portion thereof to an approximate lengthwise central protruding portion of the mounting bracket 11 via a hinge. The acceleration pedal arm 12 is integrally attached at a lower end thereof with a pedal pad 13 and connected at an upper end thereof with an end of an acceleration cable 14.

Furthermore, the acceleration cable 14 is connected at the other end thereof to a throttle valve (not shown) through the dash panel 10.

When a driver manipulates the acceleration pad 13 to accelerate the automobile, the acceleration pedal arm 12 is pivoted clockwise via the hinge while the acceleration cable 14 connected to the acceleration pedal arm 12 is pulled by the pivot motion of the acceleration pedal arm 12 to rotate the throttle valve connected to the acceleration cable 14 such that much more mixed air is introduced into an engine through the throttle valve to accelerate the automobile.

However, there is a problem in the acceleration pedal device thus described according to the prior art in that, when an automobile collides while running, shock thereof is transmitted to a body of the automobile, which in turn is applied to dash board, to cause a dash panel to protrude toward a driver, as illustrated in FIG. 2, and an acceleration pedal arm mounted at the dash panel to protrude toward the driver as well, thereby colliding with a shin part of the driver to his or her injury.

SUMMARY OF THE INVENTION

The present invention is presented to solve the aforementioned problem and it is an object of the present invention to provide an acceleration pedal device of automobile constructed to prompt an acceleration pedal to be moved back to a direction distancing from a driver when the automobile collides, thereby preventing injuries in the shin of the driver.

In accordance with the object of the present invention, there is provided an acceleration pedal device of an automobile, the device comprising:

an acceleration pedal arm movably mounted by manipulating power of a driver;

an acceleration cable connected to the acceleration pedal arm for being strained or relaxed according to movement of the acceleration pedal arm; and forcibly moving means of acceleration pedal arm for utilizing a shock generated in the course of collision to reduce a protruding height of the acceleration pedal arm toward a driver when the shock is transmitted to the acceleration cable.

It is preferred that the acceleration cable is supported by the dash panel such that the shock can be transmitted to the acceleration cable through the dash panel comprising the body of the automobile.

It is also preferred that the acceleration cable includes an external tube mounted at the dash panel for moving toward the driver along with the dash panel when the shock is applied to the dash panel; and an inner cable so installed as to be strained or relaxed according to movement of the acceleration pedal arm inside the external tube.

It is further preferred that the forcibly moving means of acceleration pedal arm includes a rack bar connected to the inner cable so as to be moved forward and backward by the inner cable according straining and relaxing movement of the inner cable and formed with a gear unit at one side thereof, a pinion rotatively meshed to the gear unit of the rack bar, and a gear unit formed at the acceleration pedal arm so as to be meshed to the pinion.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Now, preferred embodiment of the present invention will be described in detail with reference to the accompanying drawings.

Figure 1:
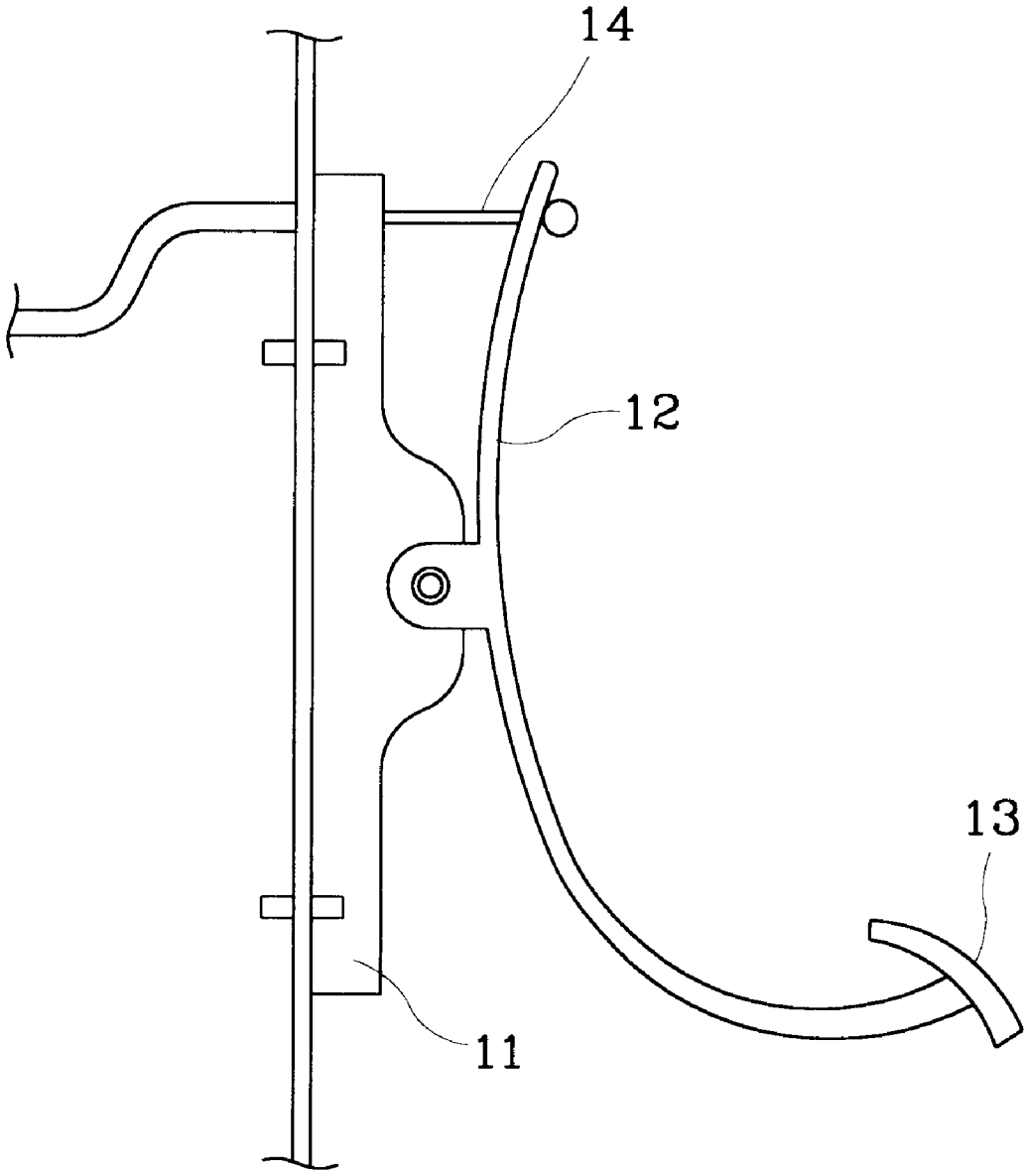
FIG.1 (Prior art)
FIG. 1 is a side view of an acceleration pedal mounted at a dash panel at a boy of the automobile according to the prior art.
Figure 2:
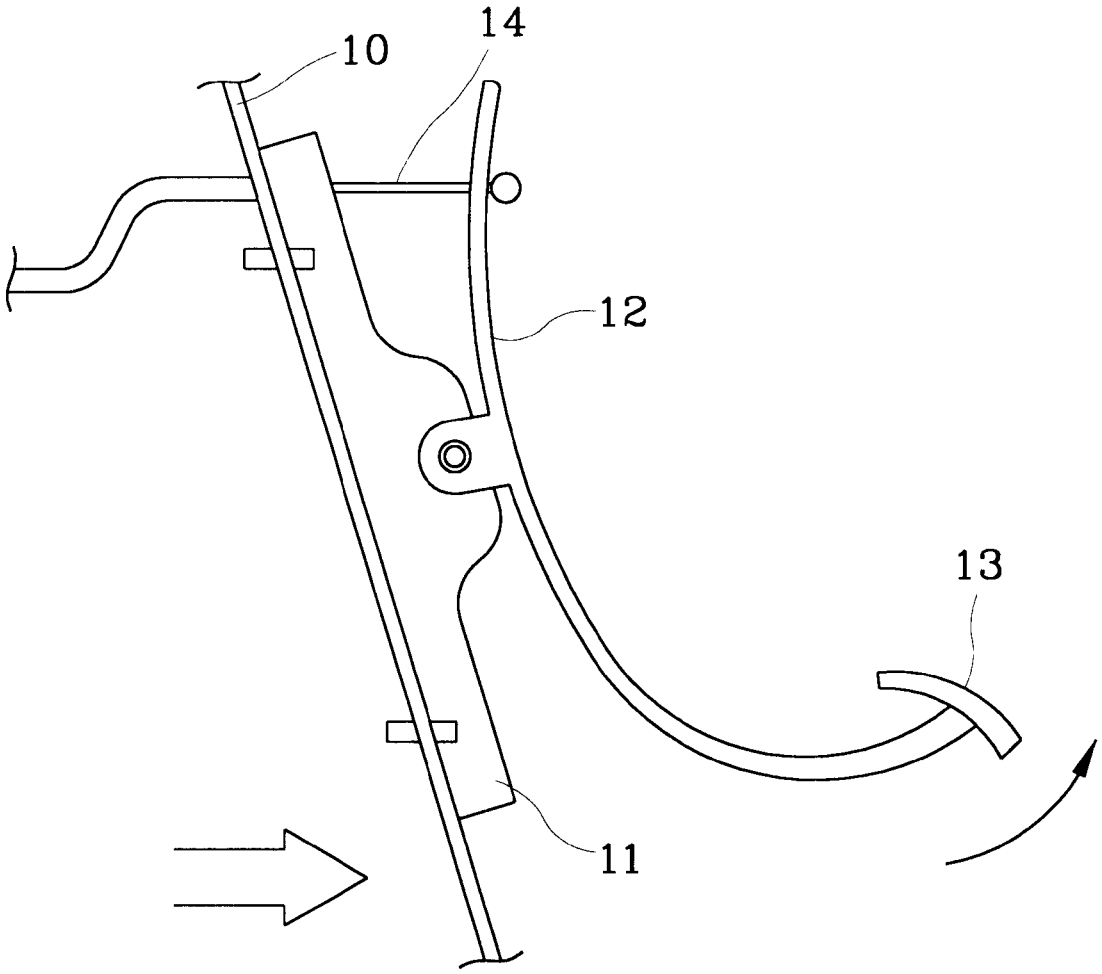
FIG.2 (Prior art)
FIG. 2 is a side view of an acceleration pedal protruded toward a driver after collision according to the prior art.
Figure 3:
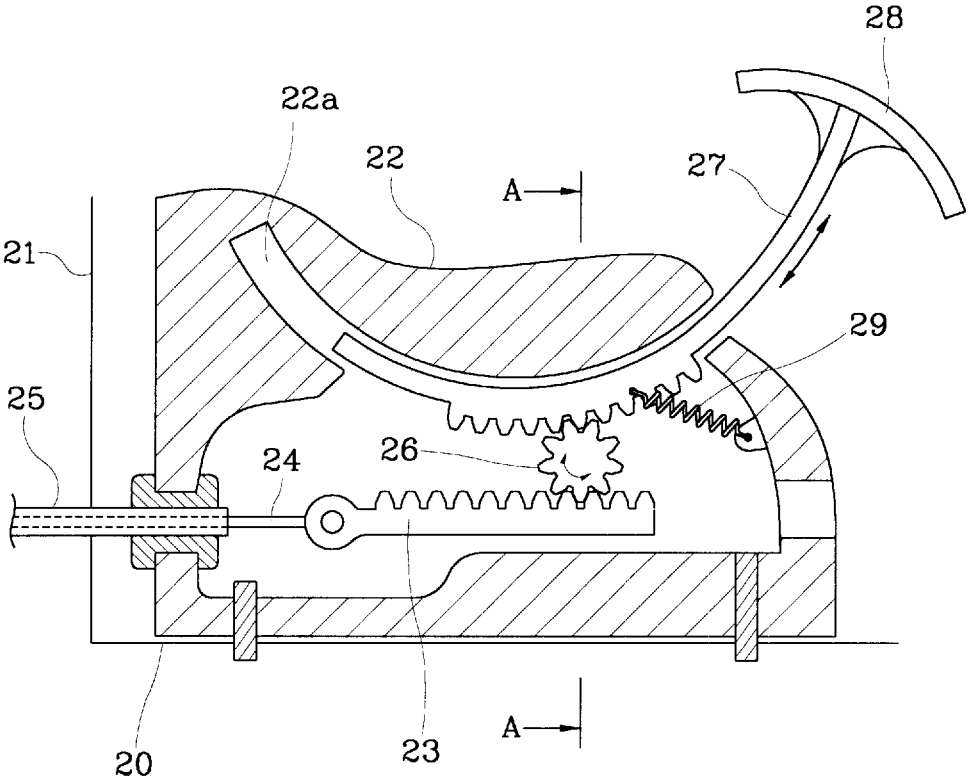
FIG. 3 is a schematic structural drawing of an acceleration pedal device according to the present invention.
Figure 4:
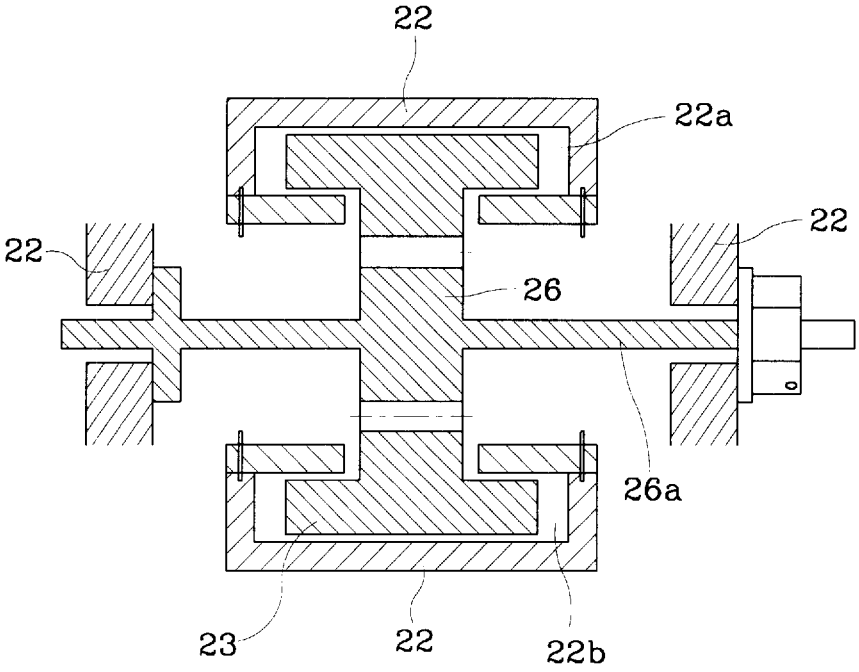
FIG. 4 is a sectional view taken along line A—A of FIG. 3.

FIG. 3 is a schematic structural drawing of an acceleration pedal device according to the present invention and FIG. 4 is a sectional view taken along line A—A of FIG. 3, where a housing 22 having a predetermined inner space is fixedly mounted at a portion adjacent to a dash panel 21 and the floor panel 20 comprising a body of the automobile, and the housing 22 is located therein with a rack bar 23 which is in turn put on a floor surface of the hosing and supported for horizontal movement, while the rack bar 23 is connected at a front end thereof to an end of an inner cable rod 24 comprising an acceleration cable.

Furthermore, an external tube 25 of the acceleration cable is supportively inserted into a holder mounted on the housing 22 for sliding thereon, and penetrates to extend through the dash panel 21.

A gear unit of the rack bar 23 is rotatatively coupled with a pinion 26 while the pinion 26 is meshed with a gear unit formed at an acceleration pedal arm 27. The acceleration pedal arm 27 is inserted into a guide groove 22*a* formed within the housing 22 to supportively move along the guide groove 22*a* while one end thereof is protruded externally out of the housing 22 where a pedal pad 28 is fixedly mounted. Meanwhile, a spring 29 resiliently supporting the acceleration pedal arm 27 is connected between an inner surface of the housing 22 and the acceleration pedal arm 27.

As illustrated in FIG. 4, the pinion 26 is integrally formed at both sides thereof with support shaft 26*a* which penetrates an inner wall of the housing 22 to be rotatatively coupled thereto. The housing 22 is formed at a floor surface thereof with a guide groove 22*b* for movably guiding the rack bar within the housing 22.

When the pedal pad 28 is manipulated in order to accelerate an automobile, the acceleration pedal arm 27 is moved along the guide groove 22*a*, being inserted into the guide groove 22*a*, and the pinion 26 is rotated clockwise by the gear unit mounted at the acceleration pedal arm 27, where the gear unit of the rack bar 23 is moved to the right on the drawing by the rotary movement of the pinion 26 to make the acceleration cable pulled, thereby increasing openedness of the throttle valve to accelerate the automobile.

Furthermore, when a driver releases the manipulating force of the pedal pad 29, the acceleration pedal arm 27 is returned to its original position by restoring resilient force of the return spring 29 to rotate the pinion 26 counterclockwise and to move the rack bar 23 to the left on the drawing, where the acceleration cable is relaxed by the movement of the rack bar to reduce the openedness of the throttle valve.

Figure 5:
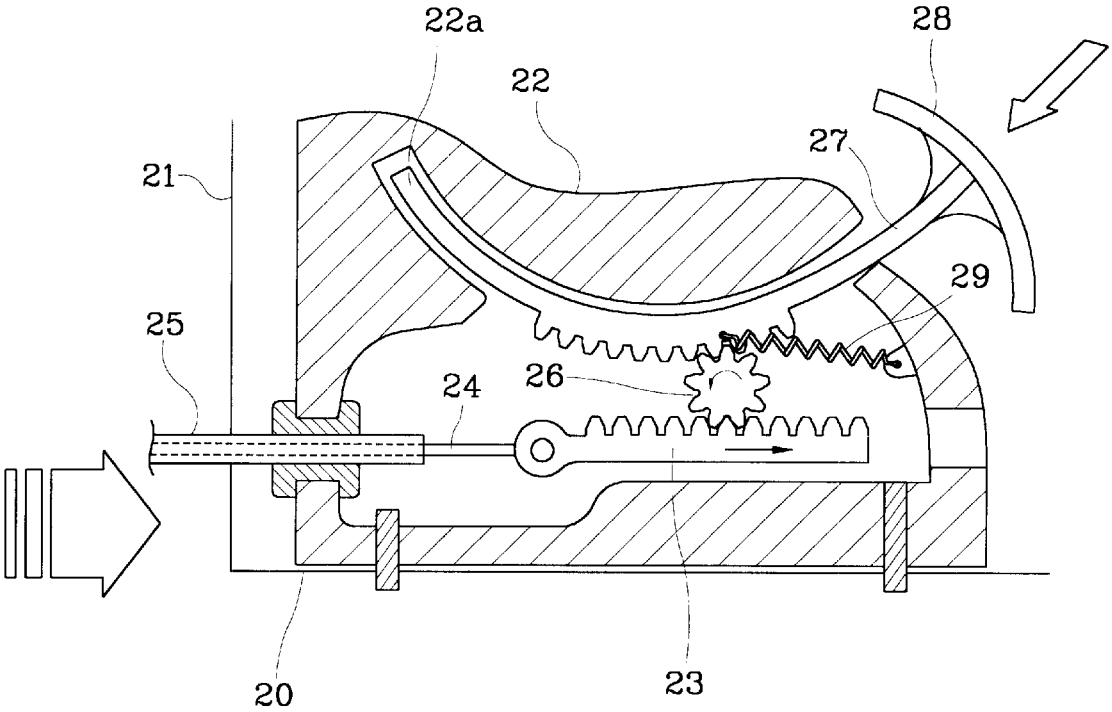
FIG. 5 is an operation explaining drawing where an acceleration pedal according to the present invention is accommodated into a housing upon collision.

Meanwhile, when an automobile collides with another vehicle or obstacle while running, shock generated therefrom is applied to the dash panel 21, as illustrated in FIG. 5, to push the dash panel 21 toward a driver, resulting in the external tube 25 of the acceleration cable supported to the dash panel 21 to be pulled along toward the driver and to be protruded into the housing 22, where the protruding movement of the external tube 25 is realized along with the inner cable to push the rack bar 23 connected to the inner cable to the right on the drawings.

As explained above, when the rack bar 23 is pushed, the pinion 26 meshed with the rack bar 23 is rotated counterclockwise, the rotary movement of the pinion being transmitted to the acceleration pedal arm 27 via the gear unit mounted at the acceleration pedal arm 27, and the acceleration pedal arm 27 is forced into the housing and the pedal pad 28 disposed at the acceleration pedal arm 27 is reduced at its height thereof, such that shin part of the driver is prevented from being injured by colliding with the pedal pad 28 and the acceleration pedal arm 27.

As apparent from the foregoing, there is an advantage in the acceleration pedal device of automobile thus described according to the present invention in that an acceleration pedal arm of acceleration pedal device is accommodated into a housing by rotary movement of a pinion and retrograding movement of a rack bar when a shock generated in the course of collision of the automobile is transmitted to the acceleration pedal device via a dash panel, thereby reducing a protruding height of the acceleration pedal arm toward a driver such that the driver is saved from injury on shin part resulting from collision with the acceleration pedal arm and pedal pad.

What is claimed is:

1. An acceleration pedal device of an automobile, the device comprising:

an acceleration pedal arm movably mounted by manipulating power of a driver;

an acceleration cable connected to the acceleration pedal arm for being strained or relaxed according to movement of the acceleration pedal arm; and forcibly moving means of acceleration pedal arm for utilizing a shock generated in the course of collision to reduce a protruding height of the acceleration pedal arm toward a driver when the shock is transmitted to the acceleration cable, wherein the acceleration cable is supported by the dash panel such that the shock can be transmitted to the acceleration cable through the dash panel comprising the body of the automobile, the acceleration cable comprises:

an external tube mounted at the dash panel for moving toward the driver along with the dash panel when shock is applied to the dash panel; and an inner cable so installed a to be strained or relaxed according to movement of the acceleration pedal arm inside the external tube; and the forcibly moving means of acceleration pedal arm comprises:

a rack bar connected to the inner cable so as to be moved forward and backward by the inner cable according straining and relaxing movement of the inner cable and formed with a gear unit at one side thereof;

a pinion rotatatively meshed to the gear unit of the rack bar; and a gear unit formed at the acceleration pedal arm so as to be meshed to the pinion.

2. The device as defined in claim 1, wherein the external tube is supported by being slidably inserted into a guide mounted at a housing having a predetermined shape of inner space, while the inner space of the housing comprises a guide groove where the acceleration pedal arm is inserted to guide movement thereof and another guide groove where the rack bar is inserted to guide movement of the rack bar, and the pinion is formed at both sides thereof with a support shaft penetrating an inner wall of the housing to be rotatatively coupled thereto.

3. The device as defined in claim 2, wherein a spring is installed to return the acceleration pedal arm when a manipulating force applied to the acceleration pedal arm is released.

* * * * *